US011073289B2

(12) United States Patent
Lee et al.

(10) Patent No.: US 11,073,289 B2
(45) **Date of Patent: *Jul. 27, 2021**

(54) COOKING DEVICE

(71) Applicant: LG ELECTRONICS INC., Seoul (KR)

(72) Inventors: Kookhaeng Lee, Seoul (KR); Jeahyuk Wie, Seoul (KR); Seungyoun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

This patent is subject to a terminal disclaimer.

(21) Appl. No.: 16/521,423

(22) Filed: Jul. 24, 2019

(65) Prior Publication Data

US 2019/0346152 A1 Nov. 14, 2019

Related U.S. Application Data

(63) Continuation of application No. 15/164,659, filed on May 25, 2016, now Pat. No. 10,422,537.

(30) Foreign Application Priority Data

May 26, 2015 (KR) ..... 10-2015-0072921

(51) Int. Cl.

| | |
|---|---|
| ***F24C 15/32*** | (2006.01) |
| ***F24C 3/08*** | (2006.01) |
| ***F24C 15/36*** | (2006.01) |
| ***F24C 15/02*** | (2006.01) |

(52) U.S. Cl.

CPC ..... *F24C 15/322* (2013.01); *F24C 3/082* (2013.01); *F24C 3/087* (2013.01); *F24C 15/36* (2013.01); *F24C 15/028* (2013.01)

(58) Field of Classification Search

CPC ..... F24C 15/322; F24C 15/36; F24C 3/087; F24C 3/082

See application file for complete search history.

(56) References Cited

U.S. PATENT DOCUMENTS

| | | | | |
|---|---|---|---|---|
| 2,612,749 | A * | 10/1952 | Tenney | F02K 7/04 60/249 |
| 5,568,803 | A * | 10/1996 | Brown | F24C 15/322 126/21 A |
| 9,488,377 | B2 * | 11/2016 | Wie | F24C 15/322 |
| 2010/0059035 | A1 * | 3/2010 | Nam | H05B 3/48 126/21 A |

(Continued)

FOREIGN PATENT DOCUMENTS

| | | | |
|---|---|---|---|
| AU | 2006235998 | B1 | 4/2007 |
| EP | 2 927 600 | A1 | 10/2015 |

(Continued)

*Primary Examiner* — David J Laux

(74) *Attorney, Agent, or Firm* — Dentons US LLP

(57) ABSTRACT

A cooking device includes a frame forming a cooking chamber; a door opening and closing the cooking chamber; a burner cover disposed in the cooking chamber; and a burner located in the burner cover, the burner generating a flame, wherein the burner cover is provided with a first hole providing a path through which air flows, and the frame is provided with a second hole communicating with the first hole, the second hole providing a path through which the air flows.

14 Claims, 12 Drawing Sheets

(56) References Cited

U.S. PATENT DOCUMENTS

| | | | | |
|---|---|---|---|---|
| 2014/0144422 | A1* | 5/2014 | Wie | F24C 15/322 126/39 E |
| 2014/0144423 | A1* | 5/2014 | Wie | F24C 3/087 126/39 E |

FOREIGN PATENT DOCUMENTS

| | | | |
|---|---|---|---|
| EP | 2 927 601 | A1 | 10/2015 |
| EP | 2 927 602 | A1 | 10/2015 |
| JP | 8-285285 | A | 11/1996 |
| JP | 9-72545 | A | 3/1997 |
| KR | 10-2003-0086081 | A | 11/2003 |
| KR | 10-2014-0067704 | A | 6/2014 |

* cited by examiner

COOKING DEVICE

CROSS-REFERENCE TO RELATED APPLICATIONS

This application is a Continuation of U.S. patent application Ser. No. 15/164,659, filed May 25, 2016, now allowed, which claims priority under 35 U.S.C. 119 and 35 U.S.C. 365 to Korean Patent Application No. 10-2015-0072921 (filed on May 26, 2015), which are hereby incorporated by reference in their entirety.

BACKGROUND

1. Field

A cooking device is disclosed herein.

2. Background

A cooking device is a device for cooking food using heat of a heating source. As an example of the cooking device, an oven range includes an oven chamber in which the food is cooked, and a burner which cooks the food in the oven chamber by burning a gas.

A conventional cooking device is disclosed in Korean Patent Publication No. 10-2010-0013997. A burner chamber is provided under a bottom surface portion of the cooking device (e.g., burner chamber) which forms an oven chamber, and a lower burner which convectively heats food in the oven chamber is installed in the burner chamber. The foregoing conventional oven range has the following problems. First, to provide air heated by the lower burner from the burner chamber into the oven chamber, the oven chamber and the burner chamber are in communication with each other. However, because the burner chamber is provided below the oven chamber, a portion of the bottom surface of the oven chamber is open. Accordingly, food leftovers or the like may be introduced into the burner chamber through an open portion of the oven chamber in communication with the burner chamber when the food is cooked in the oven chamber or the food is put into or taken out of the oven chamber. Therefore, a product may be contaminated by the food leftovers or the like.

Moreover, the oven chamber is more difficult to clean because a portion of the bottom surface of the oven chamber is open. Furthermore, the cavity capacity of the oven chamber is reduced by a burner insulation space because the lower burner is installed below the oven chamber. Additionally, the pressure inside the oven chamber changes when an oven door is opened and then closed while a mixed gas is being burned in the lower burner. At this time, the pressure inside the oven chamber is increased in the process of closing the oven door. This may result a backfiring or extinguishment of the flame generated from the lower burner.

SUMMARY

The present disclosure is directed to a cooking device.

According to an embodiment of the disclosure, a cooking device includes a frame that forms a cooking chamber, a door that provides access to an inside the cooking chamber, a burner cover provided within the cooking chamber, and a burner located within the burner cover to generate a flame, wherein the burner cover includes a first hole that provides a path through which air flows, and the frame is provided with a second hole in communication with the first hole, the second hole providing a path through which the air flows.

According to another embodiment of the disclosure, a cooking device includes a frame to form a cooking chamber, a door that provides access to an interior of the cooking chamber, a burner cover provided within the cooking chamber, and a burner located within the burner cover to generate a flame, wherein the burner cover includes a first hole through which the burner passes, the first hole having a size that is greater than the diameter of the burner, and the frame includes a second hole through which the burner passes, the second hole having a size that is greater than the diameter of the burner.

BRIEF DESCRIPTION OF THE DRAWINGS

Embodiments will be described in detail with reference to the following drawings in which like reference numerals refer to like elements, and wherein.

DETAILED DESCRIPTION OF THE EMBODIMENTS

Figure 1:
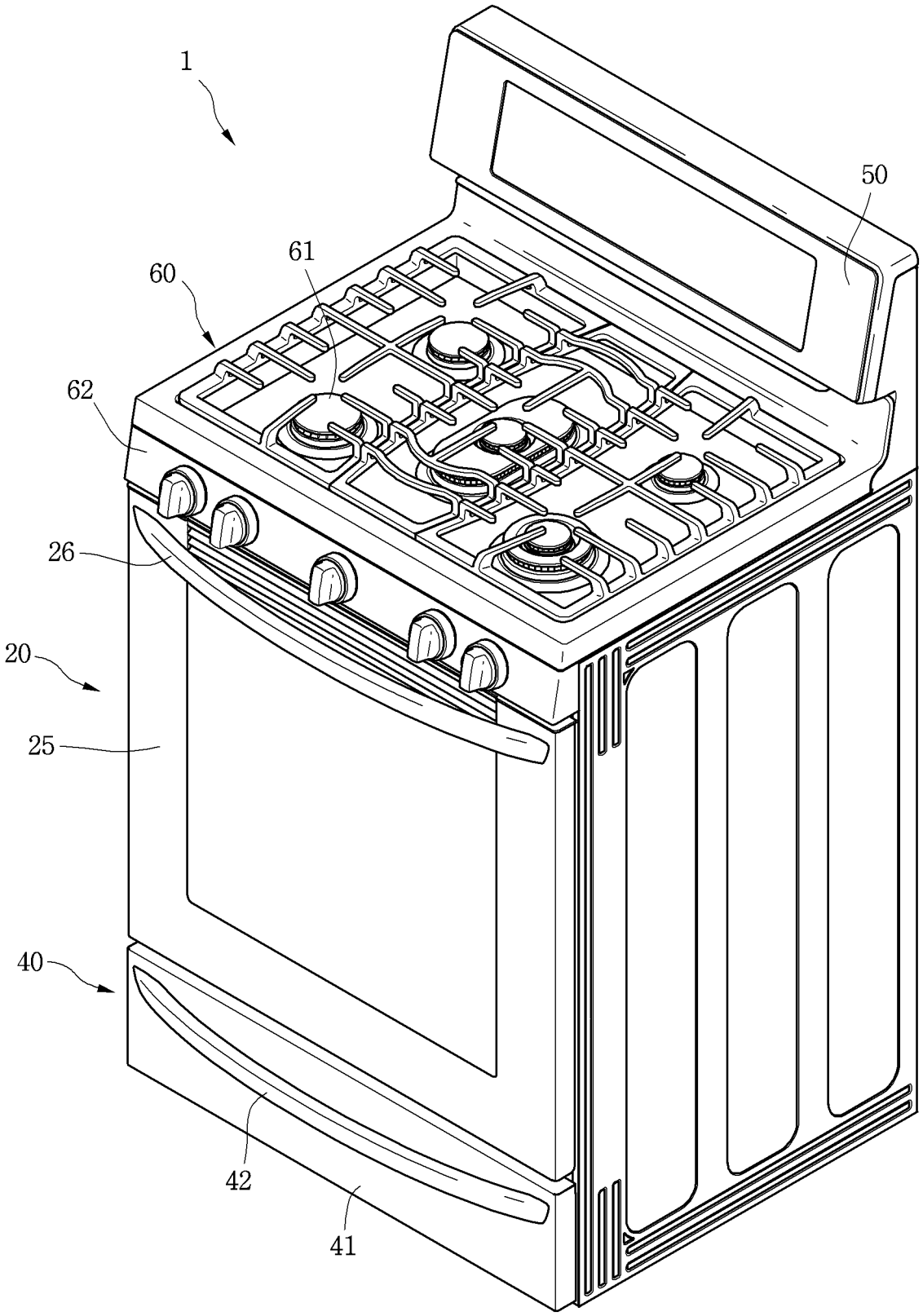
FIG. 1 is a perspective view of a cooking device according to an embodiment of the invention.

Reference will now be made in detail to the embodiments of the present disclosure, examples of which are illustrated in the accompanying drawings.

Hereinafter, exemplary embodiments of the present disclosure will be described with reference to the accompanying drawings. Regarding the reference numerals assigned to the elements in the drawings, it should be noted that the same elements may be designated by the same reference numerals, wherever possible, even though they are shown in different drawings. Also, in the description of embodiments, detailed description of well-known related structures or functions may be omitted when it is deemed that such description may cause ambiguous interpretation of the present disclosure.

Also, in the description of embodiments, terms such as first, second, A, B, (a), (b) or the like may be used herein when describing components of the present disclosure. Each of these terminologies is not used to define an order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected," "coupled," and "joined" to the latter via another component.

Figure 2:
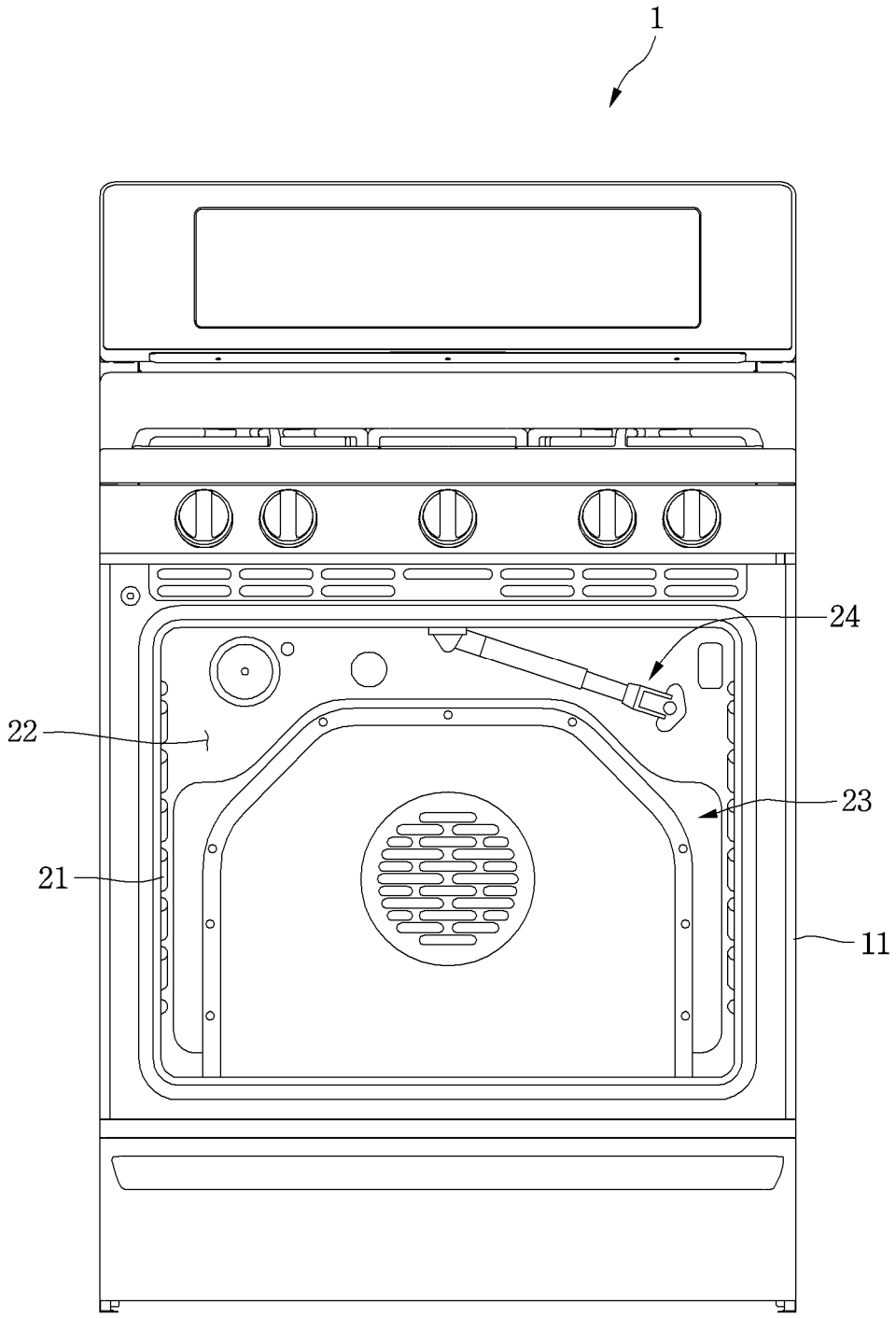
FIG. 2 is a front view when a door is removed from the cooking device according to the embodiment of the invention.

FIG. 1 is a perspective view of a cooking device according to an embodiment of the invention, and FIG. 2 is a front view when a door is removed from the cooking device according to the embodiment of the invention.

Referring to FIGS. 1 and 2, a cooking device 1 may include an oven unit 20. The cooking device 1 may include a cook-top unit 60. The cooking device 1 may include a drawer unit 40. The cooking device 1 may include a control unit 50. The cooking device 1 may include an outer case 11. The outer case 11 may cover both side surfaces and rear surfaces of the oven unit 20 and the drawer unit 40.

It is understood, however, that the cook-top unit 60 and the drawer unit 40 may be omitted according to a type of the cooking device 1.

The cook-top unit 60, the oven unit 20, and the drawer unit 40 may be provided at an upper portion, a center portion, and a lower portion of the cooking device 1, respectively. Further, the control unit 50 may be provided at a rear portion of an upper surface of the cooking device 1.

The cook-top unit 60 may include a plurality of cook-top burners 61. The cook-top burners 61 may be used, for example, to heat an item such as food. An operational unit 62 which operates the plurality of cook-top burners 61 may be provided at a front end of the cook-top unit 60. Alternatively, the operational unit 62 may be provided at an upper surface portion of the cook-top unit 60, or other location.

The cook-top unit 60 may include one or more electric heaters. However, the one or more electric heaters may not be exposed to the outside the cook-top unit 60. Therefore, in the embodiment, a type of a heating source forming the cook-top unit 60 is not limited.

The oven unit 20 may include a frame 21 forming a cooking chamber 22. For example, the frame 21 may be formed in a rectangular parallelepiped shape of which a front surface is open, but is not limited thereto.

The oven unit 20 may include a burner assembly 23. The oven unit 20 may include an upper burner 24. Thus, the burner assembly 23 and the upper burner 24 may simultaneously heat the food, or either one of the burner assembly 23 and the upper burner 24 may the inside of the cooking chamber 22.

According to an embodiment of the invention, the upper burner 24 may provide heat to food from above the food within the frame 21, and the burner assembly 23 may be provided at the rear of the food within the frame 21. For example, the upper burner 24 may be attached at an upper wall of the frame 21, and the burner assembly 23 may be attached at a rear wall of the frame 21.

The oven unit 20 may further include a door 25 to open and close the cooking chamber 22. The door 25 may be rotatably connected to the cooking device 1. For example, the door 25 may open and close the cooking chamber 22 through a pull-down method in which an upper end of the door 25 is vertically rotated about a lower end. In the embodiment, an operating method of the door 25 is not limited. A door handle 26 may be provided at an upper end of a front surface portion of the door 25.

The drawer unit 40 may function to keep the container, in which food is kept, at a predetermined temperature. A drawer 41 in which the container is accommodated may be provided at the drawer unit 40. The drawer 41 may be inserted into or withdrawn from the cooking device 1, e.g., through a sliding method. A handle 42 may be provided at a front surface portion of the drawer 41.

The control unit 50 may receive an operation signal for operating the cooking device 1, specifically, an operation signal for operating at least one of the cook-top unit 60, the oven unit 20, and the drawer unit 40. The control unit 50 may display a variety of information about the operation of the cooking device 1 to the outside of the cooking device 1.

Figure 3:
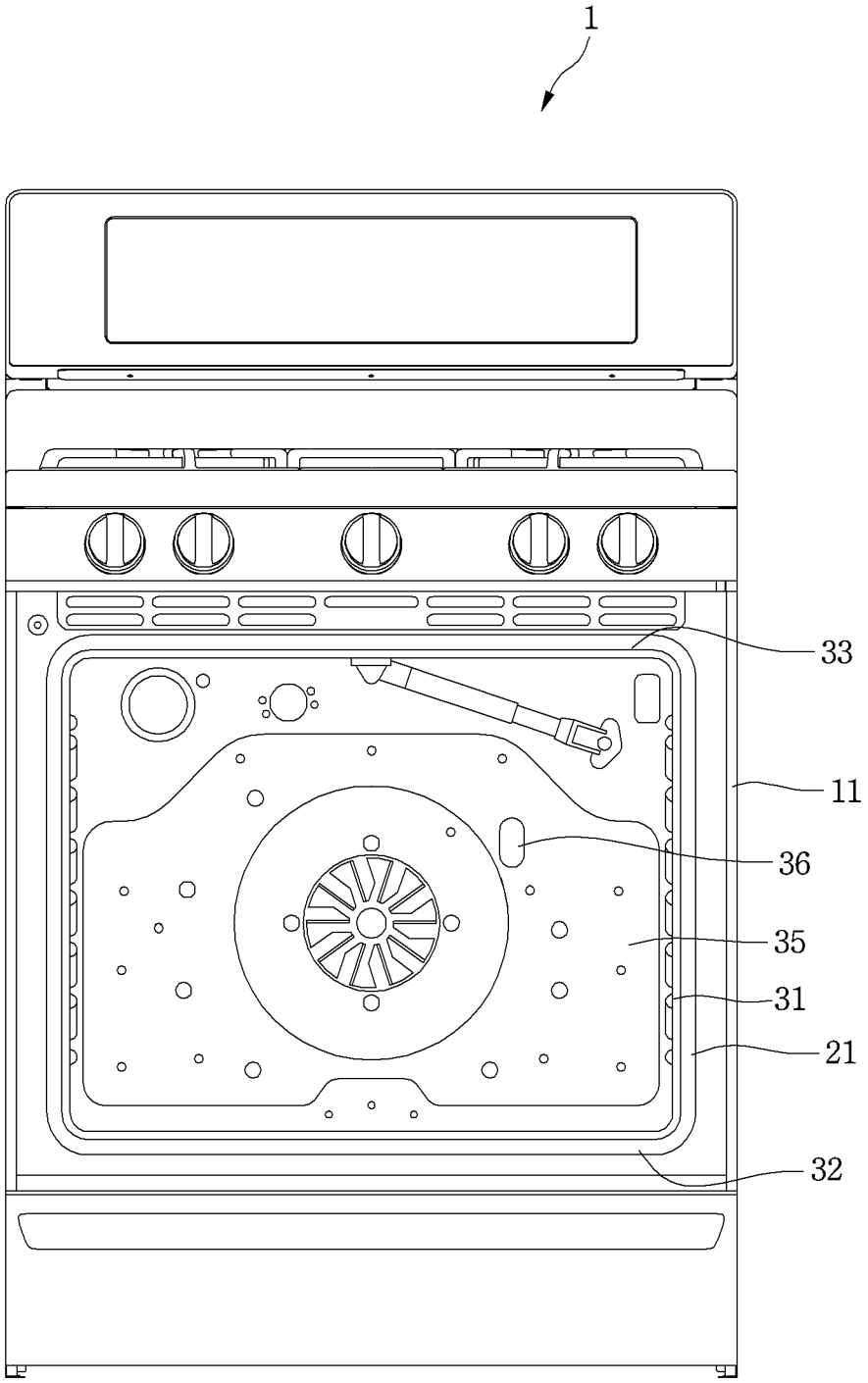
FIG. 3 is a view of the embodiment shown in FIG. 2 wherein a burner assembly is removed.
Figure 4:
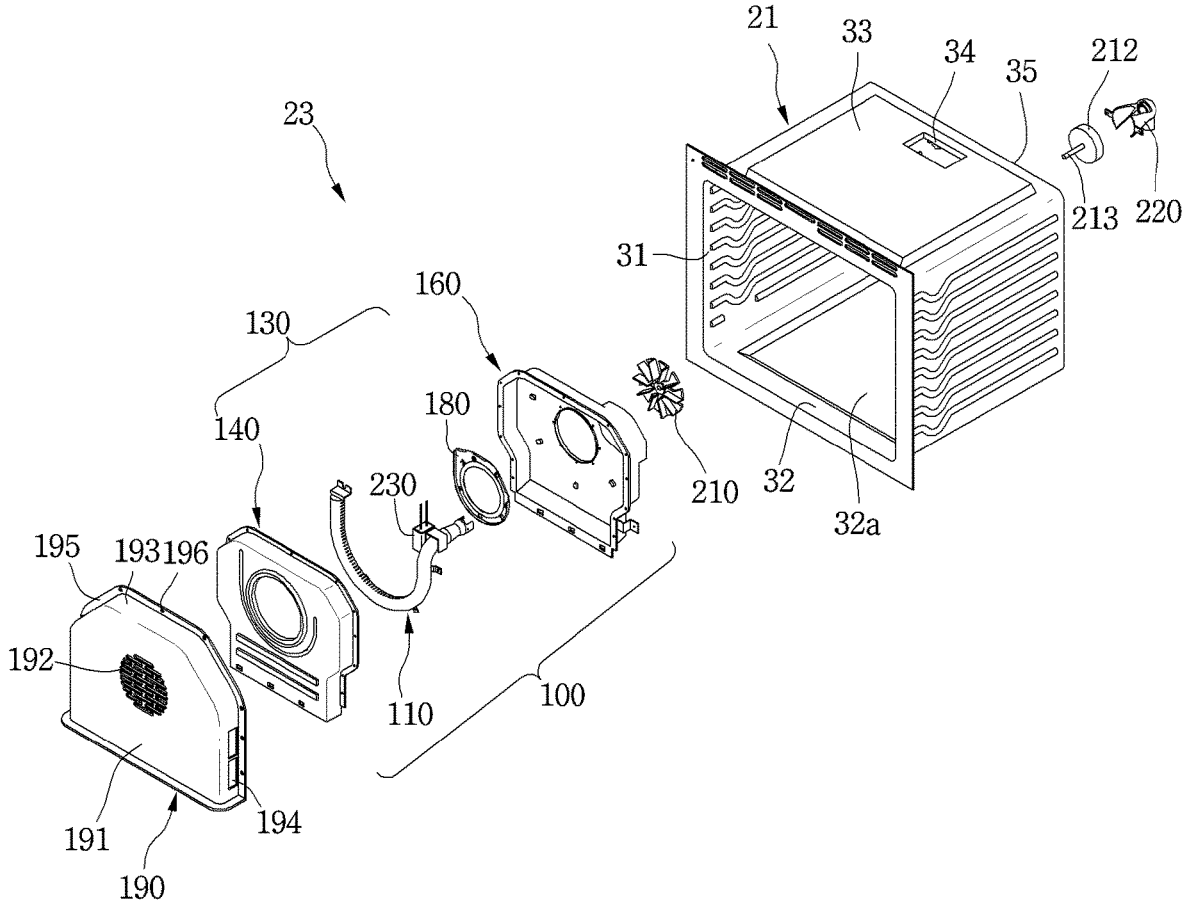
FIG. 4 is an exploded perspective view of the burner assembly according to the embodiment of the invention.

FIG. 3 is a view of the embodiment shown in FIG. 2, whereby the burner assembly is removed from the cooking device. FIG. 4 is an exploded perspective view of the burner assembly according to the embodiment of the invention.

Referring to FIGS. 2, 3 and 4, the frame 21 may include two sidewalls 31, a bottom wall 32, an upper wall 33, and a rear wall 35. It is understood that the term "front" is a direction toward a front surface portion of the cooking device 1, and the term "rear" is a direction toward a rear surface portion of the cooking device 1. Further, in the cooking chamber 22, the term "front" is a direction toward the door 25 of the oven unit 20, and the term "rear" is a direction toward the rear wall 35 of the frame 21.

The burner assembly 23 may be attached to the rear wall 35 of the frame 21. That is, in the embodiment, since the burner assembly 23 is not located below the frame 21 but is installed at the rear wall 35 of the frame 21, a recessed portion 32*a* recessed downward may be formed at the bottom wall 32 of the frame 21, and thus a capacity of the frame 21 may be increased.

Although the above-described burner assembly 23 is attached at the rear wall 35 of the frame 21, alternatively, it is understood that the burner assembly 23 may be attached at any one of the sidewalls 31 of the frame 21.

The burner assembly 23 may include a burner device 100. The burner device 100 may include a burner 110 which generates a flame by burning a gas, and a burner cover 130 which covers the burner 110. The burner assembly 23 may include an assembly cover 190 which covers the burner device 100. The burner assembly 23 may also include a fan 210 and a fan motor 212.

In the embodiment, the term "located in a frame" refers to the term "located in a space in which the frame is formed."

A burner hole 36 through which the burner 110 passes may be formed in the rear wall 35 of the frame 21. That is, the burner 110 may be located within the frame 21 and a part thereof may pass through the burner hole 36 to be located between the rear wall 35 of the frame 21 and the outer case 11.

An exhaust hole 34 through which an exhaust gas is discharged may be formed in the upper wall 33 of the frame 21. Alternatively, the exhaust hole 34 may be formed in the rear wall 35 or one of both of the sidewalls 31 of the frame 21.

The burner cover 130 may include a first cover 140 and a second cover 160. For example, at least a portion of the first cover 140 may cover the front portion of the burner 110, and at least a portion of the second cover 160 may cover the rear portion of the burner 110.

The burner device 100 may further include an ignition device 230 for igniting the mixed gas supplied to the burner 110. The burner device 100 may include a stabilizer 180 for stabilizing the flame generated from the burner 110. For example, the ignition device 230 may be installed on the burner 110 within the frame 21. When the ignition device 230 is installed on the burner 110, at least a portion of the ignition device 230 may be located in the burner cover 130.

The fan motor 212 may be located between the rear wall portion 35 of the frame 21 and the outer case 11, and the fan 210 may be located within the frame 21. Therefore, a shaft 213 of the fan motor 212 may pass through the rear wall 35 of the frame 21 and may be coupled to the fan 210. The fan motor 212 may be attached to the rear wall 35 of the frame 21 or the outer case 11 by a motor mount (not shown).

The assembly cover 190 may protect the burner device 100. The assembly cover 190 may also block or prevent foreign materials, e.g., food leftovers, from getting inside the burner device 100.

The assembly cover 190 may include a front plate 191, an extension part 193 extending from the front plate 191 toward the rear wall portion 35 of the frame 21, and a contact part 195 bent from the extension part 193.

An air suction hole 192 through which air within the cooking chamber 22 is suctioned is provided on the front plate 191, and an air discharge hole 194 through which air heated by the burner device 100 is discharged into the cooking chamber 22 is provided on the extension part 193. In another example, the air discharge hole 194 may be provided on the front plate 191 or provided on each of the front plate 191 and the extension part 193.

The contact part 195 may contact the rear wall 35 of the frame 21 when the contact part 195 covers the burner device 100. A coupling hole 196 to which a coupling member (not shown) is coupled is provided on the contact part 195.

A lower end of the assembly cover 190 may contact the bottom wall 32 of the frame 21 when the assembly cover 190 is attached to the rear wall 35 of the frame 21 by the coupling member. That is, the front plate 191 and lower ends of the extension part 193 and the contact part 195 may contact the bottom wall 32 of the frame 21. Alternatively, the front plate 191 and the extension part 193 may contact the bottom wall 32 of the frame 21.

Here, the assembly cover 190 may contact the bottom wall 32 of the frame 21 between the recessed portion 32*a* of the bottom wall 32 and the rear wall 35 of the frame 21. The burner assembly 23 may include a nozzle holder 220 for spraying gas into the burner 110. The nozzle holder 220 may be disposed between the rear wall 35 of the frame 21 and the outer case 11. For example, the nozzle holder 220 may be attached to the rear wall 35 of the frame 21. In another example, if an insulator is disposed on the outside of the frame 21, the nozzle holder 220 may be disposed on the insulator.

The nozzle holder 220 may be aligned with the burner 110 passing through the rear wall 35 of the frame 21 to spray gas into the burner 110.

Figure 5:
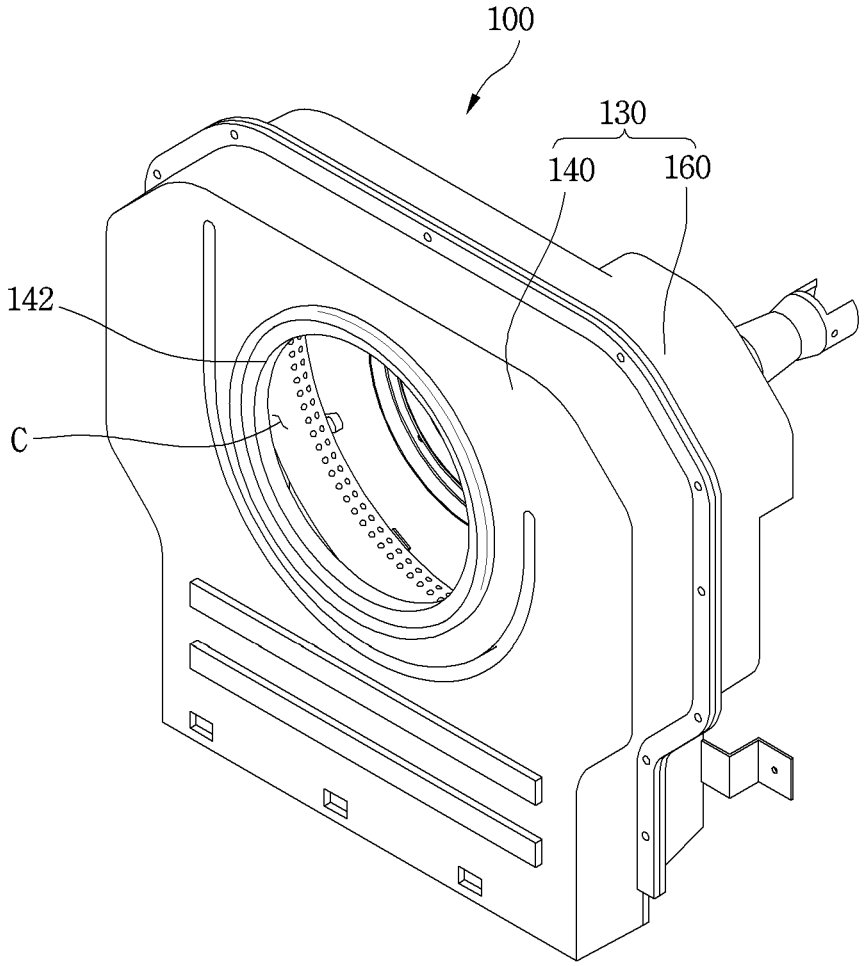
FIG. 5 is a perspective view of a burner device according to the embodiment of the invention.
Figure 6:
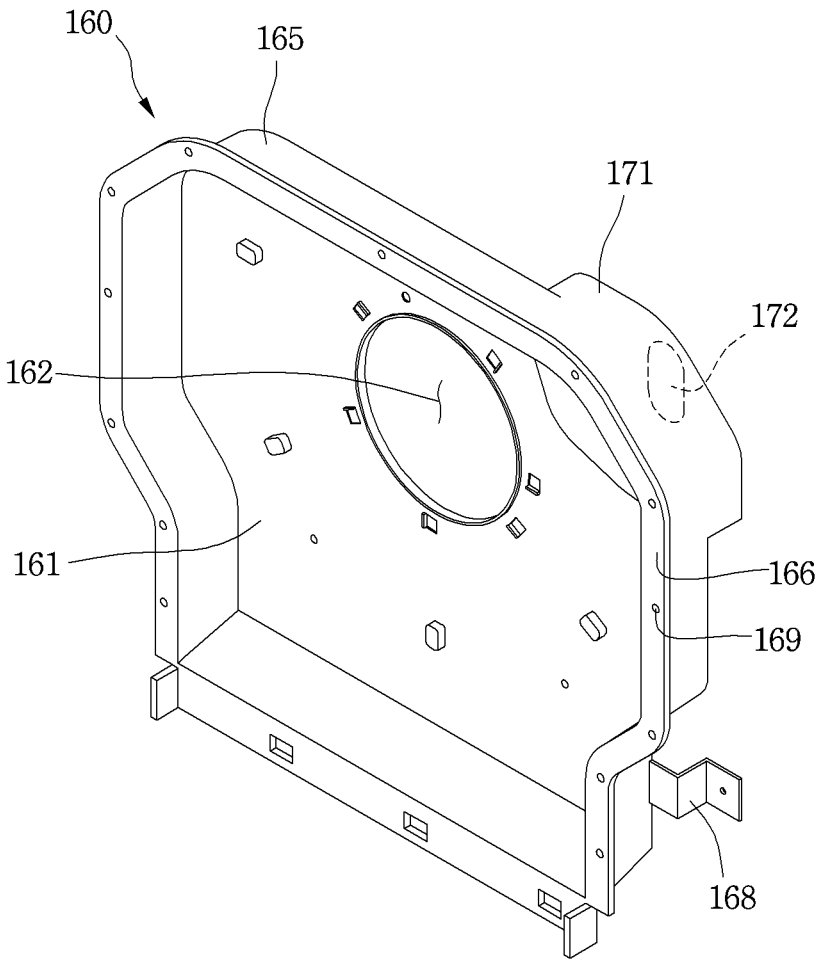
FIG. 6 is a perspective view of a second cover of the burner device shown in FIG. 5.

FIG. 5 is a perspective view of the burner device according to the embodiment of the present disclosure, and FIG. 6 is a perspective view of the second cover of the burner device shown in FIG. 5.

Referring to FIGS. 5 and 6, the burner cover 130 may form a burning chamber C in which a gas is burned. In addition, the burner 110 may be located within the burning chamber C.

The burner cover 130 may include the first cover 140 and the second cover 160, such as described above. The first cover 140 may include a first opening 142 (e.g., introduction opening) through which air in the cooking chamber 22, suctioned through the air suction hole 192 of the assembly cover 190, passes.

The air suction hole 192 of the assembly cover 190 may be formed having a grill-like configuration. For example, the air suction hole 192 may be formed by a plurality holes, but the entire outline of the air suction hole 192 formed by the plurality of holes may have, for example, a circular shape. In this configuration, the diameter of the first opening 142 may be greater than or equal to the diameter the air suction hole 192, so that the air passing through the air suction hole 192 can efficiently pass through the first opening 142 of the first cover 140.

The first opening 142 of the first cover 140 may be positioned to face the air suction hole 192 of the assembly cover 190. Thus, the air passing through the air suction hole 192 of the assembly cover 190 flows into the first opening 142 of the first cover 140 without any change in flow direction. Accordingly, air circulation within the frame 21 can be efficiently performed.

The second cover 160 may include a plate 161. The second cover 160 may further include an extending part 165 extending forward from the plate 161 and a fastening part 166 bent from the extending part 165. The plate 161 may include a second opening 162 (e.g., discharge hole) through which air heated in the burning chamber C is discharged. Although not limited thereto, the second opening 162 may be formed in a circular shape, and the diameter of the second opening 162 may be smaller than that of the first opening 142. The burner 110 may be attached to the plate 161.

The second cover 160 may further include at least one installation part 168 for attaching the second cover 160 at the rear wall 35 of the frame 21. Although not limited thereto, the at least one installation part 168 may be provided to the plate 161. Therefore, the plate 161 may be spaced apart from the rear wall 35 of the frame 21 when the second cover 160 is attached at the rear wall 35 of the frame 21 by the installation part 168. Thus, the fan 210 can be disposed in a space between the burner cover 130 and the rear wall 35 of the frame 21. In such configuration, the fan 210 is disposed in a separate space located outside the burning chamber C formed by the burner cover 130.

The second cover 160 may further include a burner through-part 171 through which a portion of the burner 110 passes. Although not limited thereto, the burner through-part 171 may protrude in a backward direction from the plate 161. That is, the plate 161 may be formed such that the burner through-part 171 protrudes backward from the plate 161.

In addition, a burner through-hole 172 may be provided in the burner through-part 171. The burner through-hole 172 may be aligned with the burner hole 36 formed in the rear wall 35 of the frame 21. That is, the burner through-hole 172 and the burner hole 36 may be positioned to face each other.

The burner through-part 171 may contact the rear wall 35 of the frame 21 when the second cover 160 is attached at the rear wall 35 of the frame 21.

The heated air passing through the second opening 162 of the burner cover 130 flows in the space between the burner cover 130 and the rear wall 35 of the frame 21 and then is discharged into the cooking chamber 22 through the air discharge hole 194 of the assembly cover 190.

As the burner through-part 171 contacts the rear wall 35 of the frame 21 when the second cover 160 is installed at the rear wall 35 of the frame 21, the heated air is prevented from being re-introduced into the burning chamber C through the burner through-hole 172.

Figure 7:
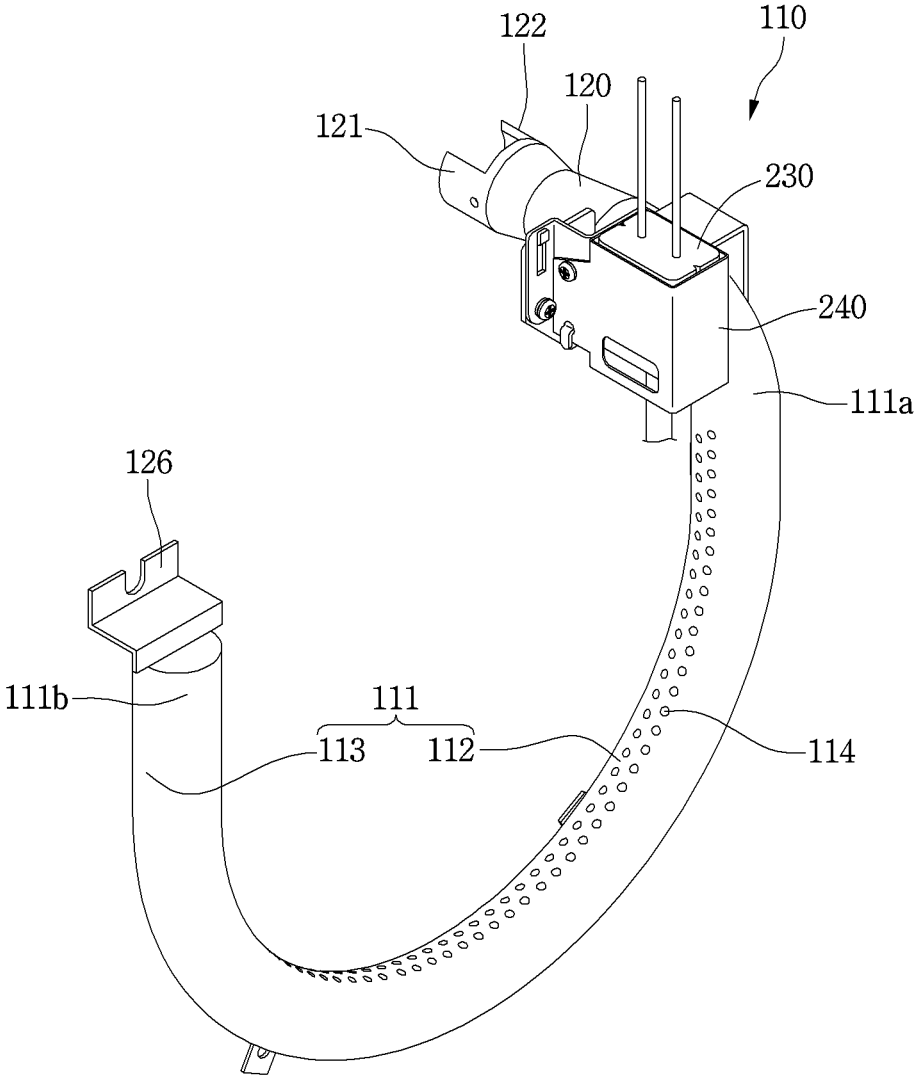
FIG. 7 is a view when an igniting portion is installed on a burner.

FIG. 7 is a perspective view of a burner on which an igniting portion is installed. Referring to FIG. 7, the burner 110 according to the embodiment of the present disclosure includes a burner tube 111 having both ends spaced apart from each other. In other words, the burner tube 111 may have a non-annular shape.

The burner tube 111 may have a "U"-like shape, but is not limited thereto. A supply part 120 for receiving gas and air may be disposed on a first end 111*a* of the burner tube 111, and a second end 111*b* of the burner tube 111 may be blocked.

The supply part 120 may inclinedly extend from the first end 111*a* of the burner tube 111. The gas and air supplied through the supply part 120 changes in flow direction from the first end 111*a* toward the second end 111*b* along the burner tube 111. Accordingly, the gas and air supplied through the supply part 120 may flow in a single direction within the burner tube 111.

The burner tube 111 may have an entirely curved shape, or at least one of the first and second ends 111*a* and 111*b* may be formed having a straight-line shape, and the other section may be formed having a curved shape.

The burner tube 111 may include an inner periphery 112 and an outer periphery 113. In the current embodiment, since the tube 111 has a "U"-like shape, the inner periphery 112 or the outer periphery 113 may have a plurality of curvatures different from each other. That is, the curvature of the inner or outer peripheries 112 and 113 of the burner tube 111 may vary in a longitudinal direction of the burner tube 111.

A plurality of gas outlet holes 114 are provided on the inner periphery 112 of the burner tube 111. The plurality of gas outlet holes 114 are arranged in a plurality of rows. In the current embodiment, the "row" may represent a set of gas outlet holes that are arranged in a direction corresponding to the extension direction of the burner tube 111.

Although the gas outlet holes 114 arranged in two rows are defined on the inner periphery 112 of the burner tube 111 in FIG. 7, the current embodiment is not limited to any particular number of rows of the gas outlet holes. That is, the gas outlet holes arranged in a single row may be defined on the inner periphery 112 of the burner tube 111.

The gas outlet holes 114 arranged in one row may be spaced apart from each other in the longitudinal direction of the burner tube 111. Also, the gas outlet holes 114 arranged in one row may be spaced apart from the gas outlet holes 114 arranged in the other row.

Although not limited thereto, the gas outlet holes 114 adjacent to each other may be disposed in a zigzag-like arrangement so that flames generated in the gas outlet holes 114 and 115 that are adjacent to each other and arranged in two rows do not interfere with each other.

That is, the gas outlet holes 114 arranged in the other row may be disposed in a region corresponding to that are between the gas outlet holes 114 adjacent to each other and arranged in one row.

At least one bracket 126 for attaching the burner tube 111 on the second cover 160 may be disposed on the burner tube 111. When at least one bracket 126 is attached to the second cover 160, the burner tube 111 may be spaced apart from the plate 161 of the second cover 160. The at least one bracket 126 may be attached to the second cover 160 by a screw (as shown), or any other coupling device or structure.

The supply part 120 may pass through the burner through-hole 172 of the second cover 160 and the burner hole 36 of the rear wall 35 of the frame 21.

In the embodiment, the burner through-hole 172 may be referred to as a first hole that provides an air flow path, and the burner hole 36 of the rear wall 35 may be referred to as a second hole that provides an air flow path.

According to the embodiment, since the plurality of gas outlet holes are formed at an inner periphery of the burner 110, and the air passes through an area formed by the plurality of gas outlet holes, the air in the cooking chamber 22 may be sufficiently heated by heat of the flame of the burner 110.

Also, because the flame is generated at the inner periphery of the burner 110, the distance between the flames is reduced, as it becomes distant from the gas outlet holes, and thus a phenomenon in which the flame is extinguished due to air flow may be prevented.

A relative position of the ignition device 230 with respect to the burner 110 may be provided by a fixing device 240. For example, the ignition portion 230 may be attached at the burner 110 by the fixing device 240.

Figure 8:
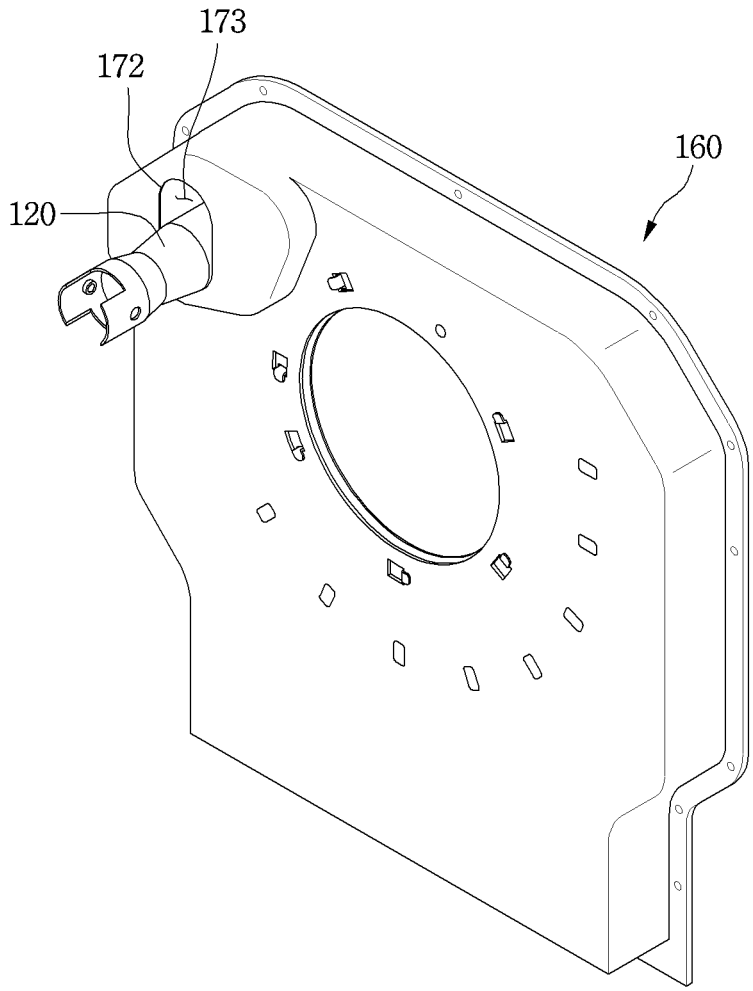
FIG. 8 is a view when the burner passes through the second cover according to the embodiment of the invention.

FIG. 8 is a view when the burner passes through the second cover according to the embodiment of the present disclosure. Referring to FIGS. 5 and 8, the burner 110 may pass through the burner through-hole 172 when the burner 110 is located in the burning chamber C of the burner cover 130. That is, the supply part 120 of the burner 110 may be located at the outside of the burning chamber C by passing through the burner through-hole 172.

The size of the burner through-hole 172 may be greater than the diameter of the supply part 120. Therefore, a path 173 may be formed in the burner through-hole 172 when the supply part 120 passes through the burner through-hole 172.

Air located the outside of the burning chamber C may be introduced into the burning chamber C by the path 173. When the pressure of the burning chamber C is increased, the air in the burning chamber C may be discharged such that the increased pressure of the burning chamber C returns to the original pressure.

Figure 9:
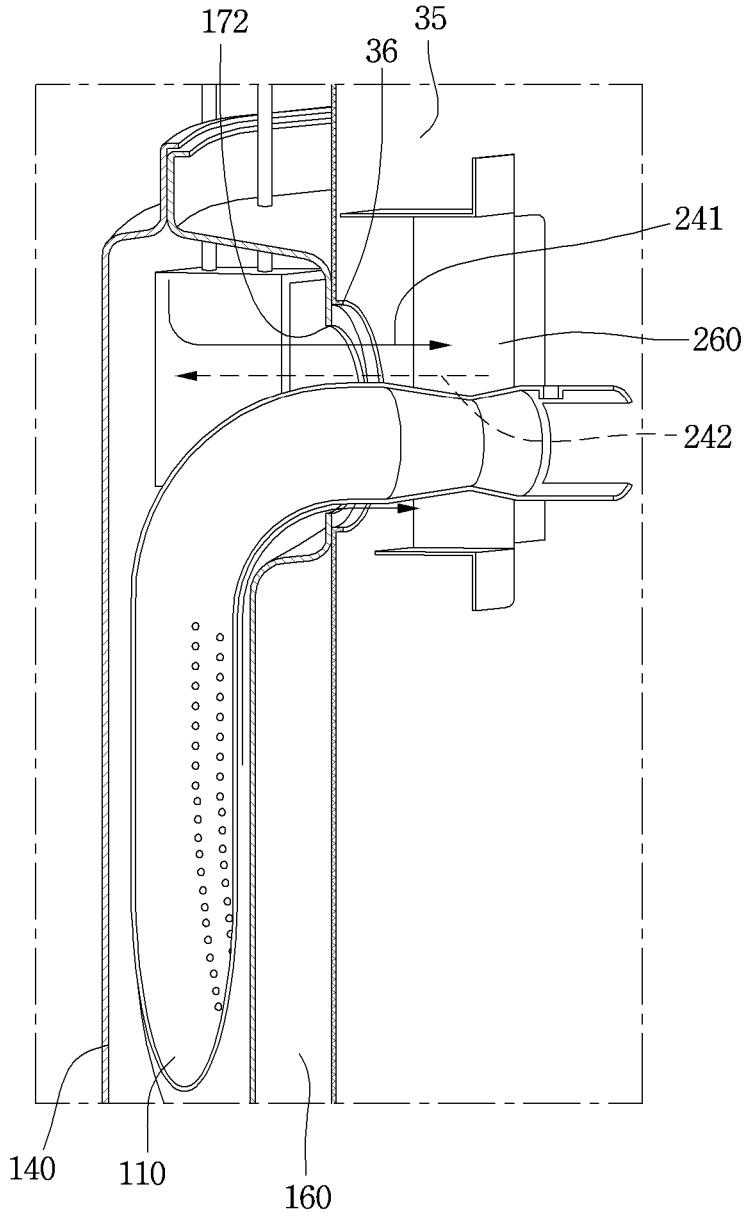
FIG. 9 is a view when the burner passes through a burner cover and a rear wall of a frame according to the embodiment of the invention.
Figure 10:
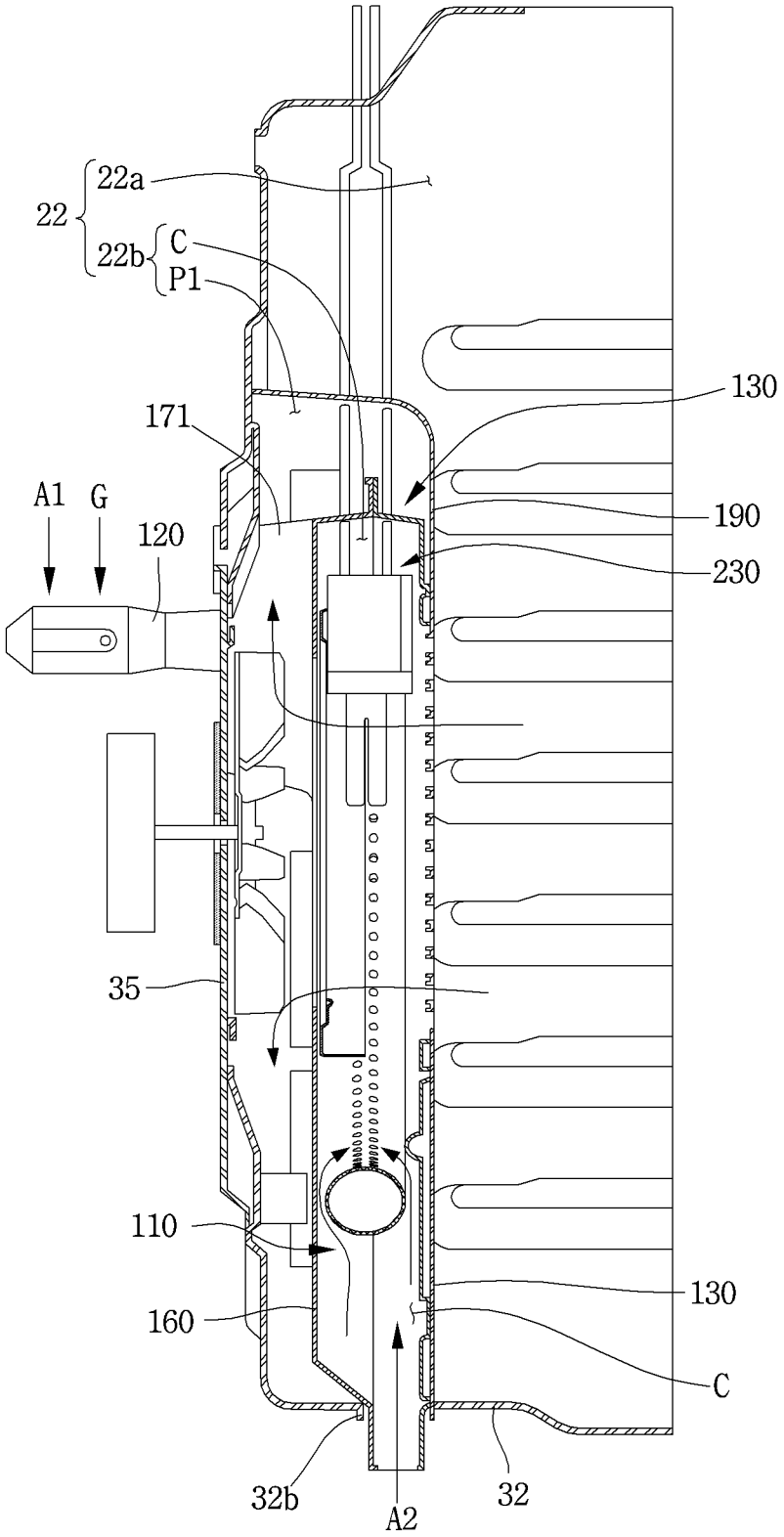
FIG. 10 is a vertical sectional view when the burner assembly is installed in the burner assembly according to the embodiment of the invention.

FIG. 9 is a view that shows when the burner passes through the burner cover and the rear wall of the frame according to an embodiment of the present disclosure. FIG. 10 is a vertical sectional view when the burner assembly is installed in the burner assembly according to the embodiment of the present disclosure.

Referring to FIGS. 1 to 10, the burner 110 passing through the burner through-hole 172 of the burner cover 130 may pass through the burner hole 36 in the rear wall 35 of the frame 21. The size of the burner hole 36 may be greater than that of the burner through-hole 172. That is, the area of the burner hole 36 may be larger than that of the burner through-hole 172.

When the door 20 is opened and then closed while the mixed gas is burned in the burner 110, the pressure of the cooking chamber 22 is increased. At this time, when there is no component for reducing the pressure of the cooking chamber 22 when the pressure of the cooking chamber 22 is increased, the increased pressure has influence on the burner 110. Therefore, the flame generated from the burner 110 may backfire or extinguish.

However, according to the present disclosure, the burner through-hole 172 and the burner hole 36 each have a diameter that is greater than that of the burner 110. Thus, although the pressure of the cooking chamber 22 is suddenly increased, air 241 inside the cooking chamber 22 can be quickly discharged to the outside of the cooking chamber 22 through the burner through-hole 172 and the burner hole 36. Accordingly, the pressure can be prevented from having influence on the burner 110, so that it is possible to prevent the backfire or extinguishment of the flame generated from the burner 110. Accordingly, the burner through-hole 172 and the burner hole 36 may be arranged to face the door 25, so that the air can be quickly discharged.

As another example, a hole for enabling air to flow separately from the burner through-hole 172 and the burner hole 36 may be formed in the burner cover 130 and the rear wall 35 of the frame 21.

A holder supporter 260 supporting the nozzle holder 220 may be provided between the rear wall 35 of the frame 21 and the outer case 11. The holder supporter 260 may be attached at the rear wall 35 of the frame 21. Alternatively, when an insulator (not shown) is disposed outside of the frame 21, the holder supporter 260 may be disposed on the insulator.

The holder supporter 260 may also function as a blocking wall to block or prevent foreign substances (e.g., fragments of the insulator) from being introduced into the frame 21.

The holder supporter 260 may be configured to surround the circumference of the supply part 120. For example, the supply part 120 may pass through the holder supporter 260. In this case, at least one portion of the circumference of the supply part 120 may be spaced apart from the holder supporter 260.

The entire burner hole 36 may overlap with a region formed by the holder support 260 when the holder supporter 260 contacts the rear wall 35 of the frame 21. Thus, the holder supporter 260 can block or prevent foreign substances from being introduced into the burner hole 36 while providing an air path.

Meanwhile, when the operation of the burner assembly 23 is started, a gas is sprayed from the nozzle holder 220 to the supply part of the burner 110. Then, air A1 around the supply part 120 (air at the outside of the frame) is supplied together with the gas to the supply part 120. At this time, as the surroundings of the gas supplied to the supply part 120 are formed with a low pressure, the air A1 around the supply part 120 is naturally supplied to the supply part by a pressure difference (a natural air supply method).

Therefore, when the air is supplied to the supply part 120 in the natural air supply method, air required to burn the gas may not be sufficiently supplied to the supply part 120. In this case, a mixed gas formed by mixing the gas and the air may be incompletely burned in the burner 110, and therefore, the amount of carbon monoxide generated due to the incomplete burning may be increased.

However, according to the present disclosure, an additional air 242 for burning the mixed gas may be supplied into the burning chamber C through the burner hole 36 and the burner through-hole 172.

In addition, a portion of the burner cover 130 may be located outside of the frame 21 by passing through the bottom wall 32 of the frame 21. Thus, an additional air A2 for burning the mixed gas can be efficiently introduced into the burning chamber C.

The mixed gas is ignited by the ignition device 230 when the mixed gas is supplied to the burner 110, so that the flame is generated from the burner 110. Then, the fan motor 212 is turned on such that the fan 210 is rotated.

When the fan 210 rotates, the air in the cooking chamber 22 is introduced into the burning chamber C through the air suction hole 192 of the assembly cover 190. At this time, the air introduced into the burning chamber C passes through a region formed by an inner circumferential surface 112 of the burner 110.

The air introduced into the burning chamber C is heated by the flame generated from the burner 110 and then discharged from the burning chamber C.

The air discharged from the burning chamber C flows through an exhaust flow path P1 between the second cover 160 and the rear wall 35 of the frame 21 and then is discharged into the cooking chamber 22 through the air discharge hole 194 of the assembly cover 190.

In the embodiment, the burner cover 130 forms an independent burning chamber C, and the burning chamber C and the exhaust flow path P1 are separated by the burner cover 130. Thus, the air flowing through the exhaust flow path P1 can be prevented from being re-introduced into the burning chamber C.

Figure 11:
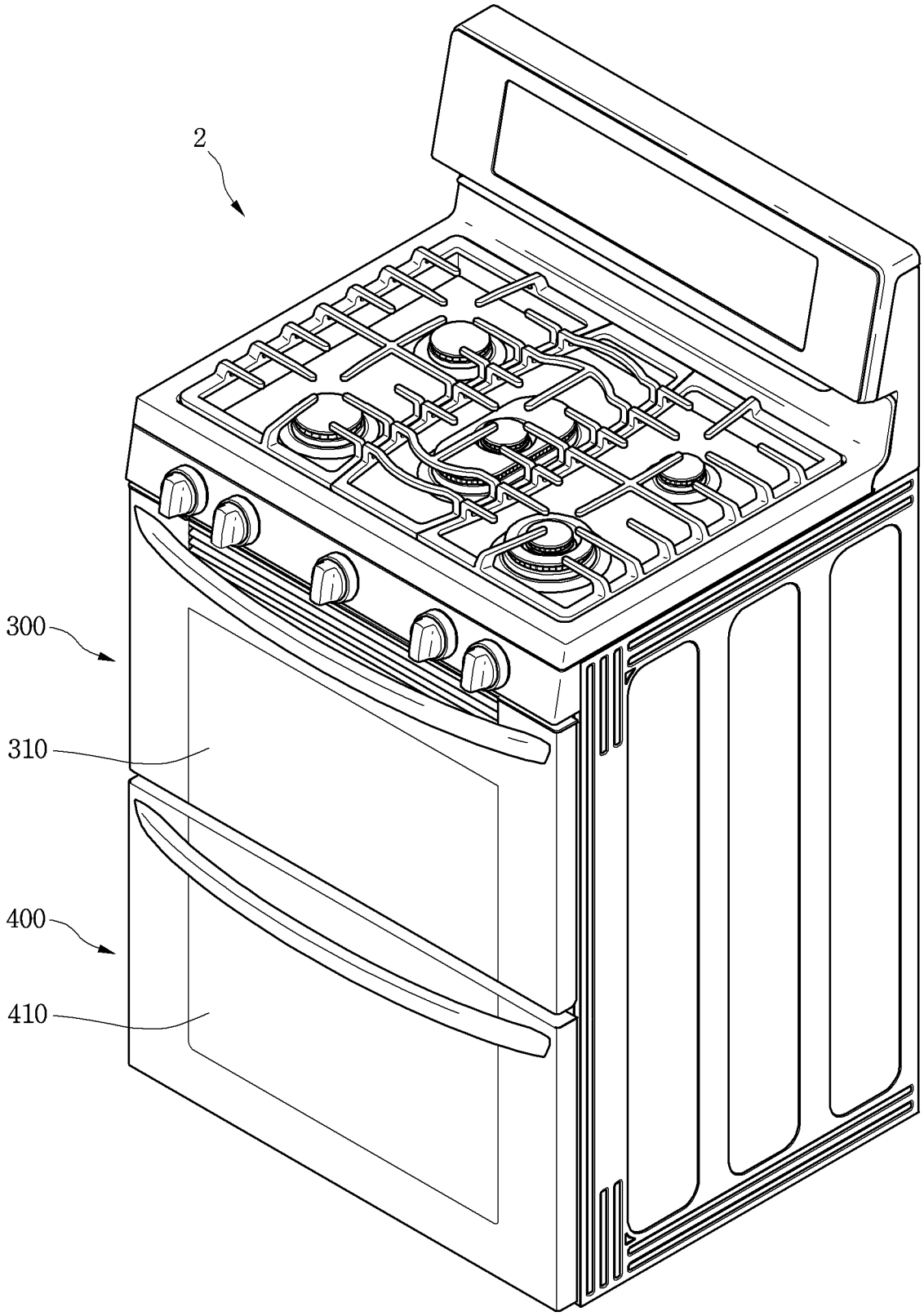
FIG. 11 is a perspective view of a cooking device according to another embodiment of the invention.
Figure 12:
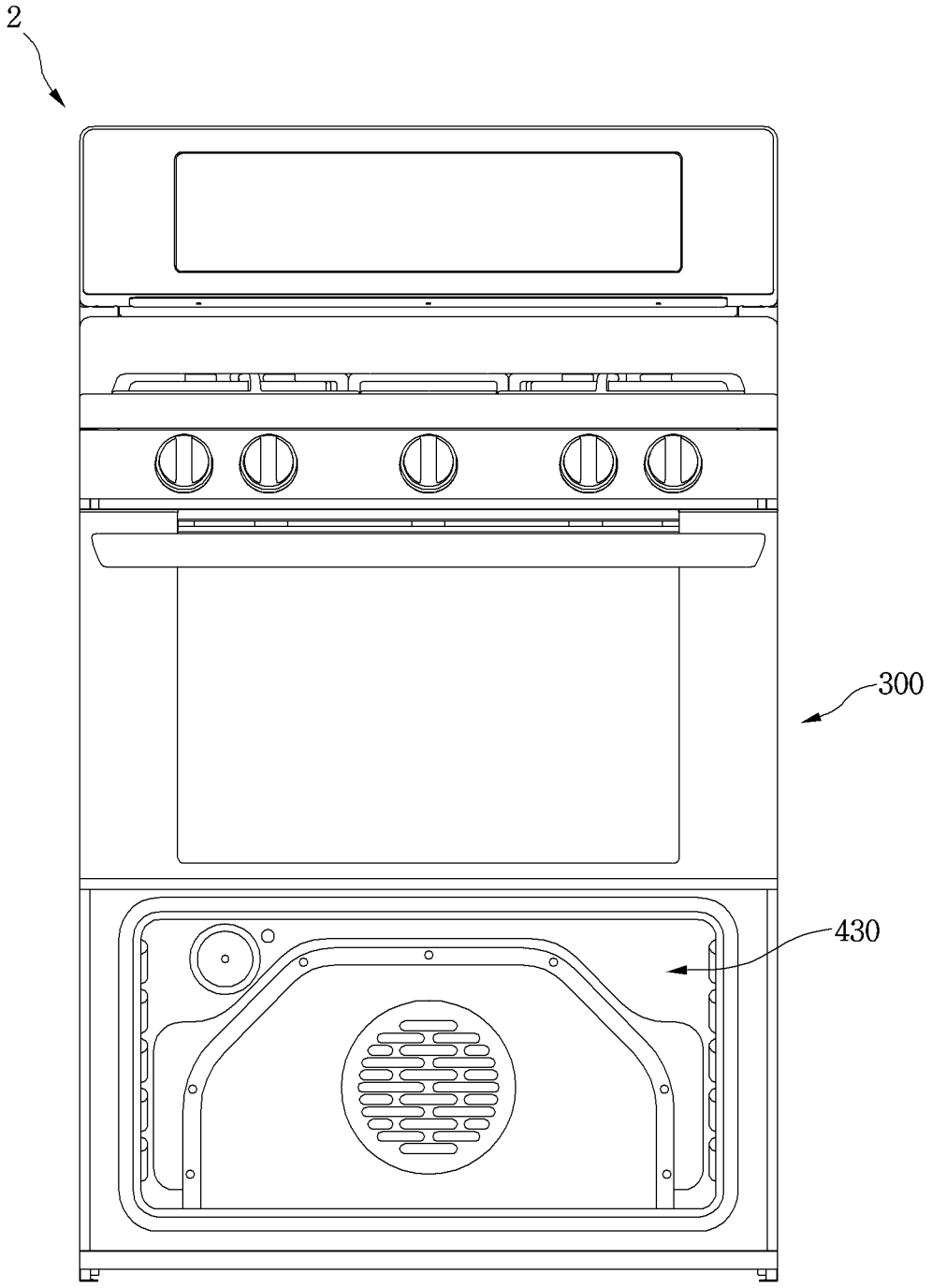
FIG. 12 is a front view of the cooking device of the embodiment shown in FIG. 11 wherein a second door is removed.

FIG. 11 is a perspective view of a cooking device according to another embodiment of the present disclosure. FIG. 12 is a front view of the cooking device in which a second door is removed in FIG. 11. For ease of discussion, the current embodiment is the same as the previous embodiment except for the number of oven units.

Referring to FIGS. 11 and 12, a cooking device 2 according to a second embodiment may include a plurality of oven units 300 and 400. The plurality of oven units 300 and 400 may include a first oven unit 300 and a second oven unit 400 disposed below the first oven unit 300. The plurality of oven units 300 and 400 may include doors 310 and 410, respectively.

A burner assembly 430 may be disposed on at least one of the plurality of oven units 300 and 400. Since the burner assembly 430 has the same structure as that of the foregoing embodiment, for ease of discussion, its detailed description will be omitted.

Although the burner assembly 430 shown in FIG. 12 is disposed on the second oven unit 400, it is understood that the burner assembly 430 may be disposed on the first oven unit 300 or each of the plurality of oven units 300 and 400.

Even though all the elements of the embodiments are coupled into one or operated in the combined state, the present disclosure is not limited to such embodiments. That is, all the elements may be selectively combined with each other without departing from the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms need to be construed with meanings used in technical contexts and are not construed with ideal or excessively formal meanings unless otherwise clearly defined herein.

What is claimed is:

1. A cooking device comprising:

a frame that forms a cooking chamber, the frame comprising a rear wall;

a door that provides access to an inside of the cooking chamber;

a burner cover provided within the cooking chamber, the burner cover forming a burning chamber in which a gas is burned;

a burner located within the burning chamber of the burner cover to generate a flame;

a fan provided between the burner cover and the rear wall of the frame; and a burner through-part formed in the burner cover, the burner through-part through which a portion of the burner passes, wherein the burner through-part includes a first hole through which the burner passes to provide a path through which air flows, wherein the rear wall of the frame includes a second hole in communication with the first hole, the second hole providing a path through which the air flows, and wherein the burner through-part protrudes in a backward direction from the burner cover to contact the rear wall of the frame.

2. The cooking device of claim 1, wherein the first hole is positioned to face the second hole.

3. The cooking device of claim 1, wherein the first and second holes are each positioned to face the door.

4. The cooking device of claim 1, wherein a portion of the burner passes through the first and second holes and is located outside the cooking chamber.

5. The cooking device of claim 4, wherein the size of each of the first and second holes is greater than the diameter of the burner.

6. The cooking device of claim 4, wherein the area of the second hole is larger than the area of the first hole.

7. The cooking device of claim 4, wherein the burner cover comprises:

a first cover having an introduction opening through which air of the cooking chamber is passed; and a second cover forming at least a portion of a burning chamber in which the burner is located, the second cover having a discharge opening through which air is discharged into the cooking chamber, wherein the first hole is formed in the second cover.

8. The cooking device of claim 7, wherein the burner through-part is located at a corner area of the second cover.

9. The cooking device of claim 1, further comprising:

a blocking wall disposed outside of the frame, the blocking wall configured to prevent foreign substances located outside the frame from being introduced into the cooking chamber through the second hole.

10. The cooking device of claim 9, wherein the blocking wall is provided to surround the portion of the burner that passes through the second hole.

11. The cooking device of claim 10, wherein at least a portion of the blocking wall is spaced from the burner and forms a flow path for air.

12. The cooking device of claim 9, further comprising:

a nozzle holder having a nozzle that supplies a gas to the burner, wherein the nozzle holder is provided at the blocking wall.

13. The cooking device of claim 9, wherein the blocking wall is provided on the frame or on an insulator surrounding the circumference of the frame.

14. The cooking device of claim 1, wherein a portion of the burner cover passes through the frame and is located outside the cooking chamber, whereby air that is outside the frame is passed into the burner cover.

* * * * *